US011000436B2

(12) United States Patent
Yochum

(10) Patent No.: US 11,000,436 B2
(45) Date of Patent: May 11, 2021

(54) PATIENT TRANSFERRING BED ASSEMBLY

(71) Applicant: Richard Yochum, Lakewood, NJ (US)

(72) Inventor: Richard Yochum, Lakewood, NJ (US)

( * ) Notice: Subject to any disclaimer, the term of this patent is extended or adjusted under 35 U.S.C. 154(b) by 266 days.

(21) Appl. No.: 16/250,749

(22) Filed: Jan. 17, 2019

(65) Prior Publication Data

US 2020/0230003 A1 Jul. 23, 2020

(51) Int. Cl.
*A61G 7/10* (2006.01)

(52) U.S. Cl.
CPC ..... *A61G 7/1026* (2013.01); *A61G 7/1046* (2013.01); *A61G 7/103* (2013.01); *A61G 7/1036* (2013.01)

(58) Field of Classification Search
CPC ..... A61G 7/10; A61G 7/1025; A61G 7/1034; A61G 7/1026; A61G 7/1046; A61G 7/103; A61G 7/1036
See application file for complete search history.

(56) References Cited

U.S. PATENT DOCUMENTS 2,691,782 A * 10/1954 West ..... A61G 7/1046 5/81.1 HS
4,259,756 A * 4/1981 Pace ..... A61G 7/1046 5/425
4,274,168 A * 6/1981 Depowski ..... A61G 7/1034 414/523
4,794,655 A * 1/1989 Ooka ..... A61G 7/1019 5/81.1 C
4,873,732 A * 10/1989 Perez ..... A61G 7/1019 5/81.1 HS
4,987,621 A * 1/1991 Brantman ..... A61G 7/103 5/81.1 HS
5,067,188 A * 11/1991 Brantman ..... A61G 7/103 5/81.1 HS
5,185,894 A * 2/1993 Bastert ..... A61G 7/1019 5/81.1 C
5,937,456 A * 8/1999 Norris ..... A61G 7/1019 5/81.1 R
6,584,626 B1 * 7/2003 DiRoma ..... A61G 7/1034 193/35 R
6,802,091 B1 * 10/2004 Harris ..... A61G 7/1019 5/81.1 HS
7,487,559 B1 * 2/2009 Denosky ..... A61G 7/1025 5/81.1 HS
8,356,368 B2 * 1/2013 Patterson ..... A61G 7/1057 5/81.1 C
D675,467 S 2/2013 Gomez
(Continued)

*Primary Examiner* — Robert G Santos
*Assistant Examiner* — Rahib T Zaman

(57) ABSTRACT

A patient transferring bed assembly includes hospital bed that has a mattress deck and a plurality of legs. A gurney is provided that includes a mattress panel and a plurality of legs. The gurney is positionable in a transferring position having the mattress panel being positioned adjacent to and being oriented coextensive with the mattress deck on the hospital bed. A mattress is slidably coupled to the mattress panel on the gurney and a patient lies on the mattress. The mattress slidably engages the mattress deck on the hospital bed when the gurney is positioned in the transferring position and the mattress is urged to slide laterally onto the mattress deck. In this way the mattress transfers the patient from the gurney to the hospital bed without requiring the patient to be lifted.

7 Claims, 5 Drawing Sheets

(56) References Cited

U.S. PATENT DOCUMENTS

| | | | | |
|---|---|---|---|---|
| 8,601,619 | B2 * | 12/2013 | McNulty | A61G 7/1032 5/81.1 C |
| 9,393,168 | B2 * | 7/2016 | Konda | A61G 7/1032 |
| 2005/0066442 | A1 * | 3/2005 | Kasagami | A61G 7/1065 5/81.1 C |
| 2012/0066831 | A1 * | 3/2012 | Jei | A61G 7/1046 5/81.1 R |
| 2017/0027795 | A1 * | 2/2017 | Asil | A61G 7/1063 |

* cited by examiner

PATIENT TRANSFERRING BED ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to patient transferring devices and more particularly pertains to a new patient transferring device for slidably transferring a patient between a gurney and a bed, or vice verse.

BRIEF SUMMARY OF THE INVENTION

An embodiment of the disclosure meets the needs presented above by generally comprising a hospital bed that has a mattress deck and a plurality of legs. A gurney is provided that includes a mattress panel and a plurality of legs. The gurney is positionable in a transferring position having the mattress panel being positioned adjacent to and being oriented coextensive with the mattress deck on the hospital bed. A mattress is slidably coupled to the mattress panel on the gurney and a patient lies on the mattress. The mattress slidably engages the mattress deck on the hospital bed when the gurney is positioned in the transferring position and the mattress is urged to slide laterally onto the mattress deck. In this way the mattress transfers the patient from the gurney to the hospital bed without requiring the patient to be lifted.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
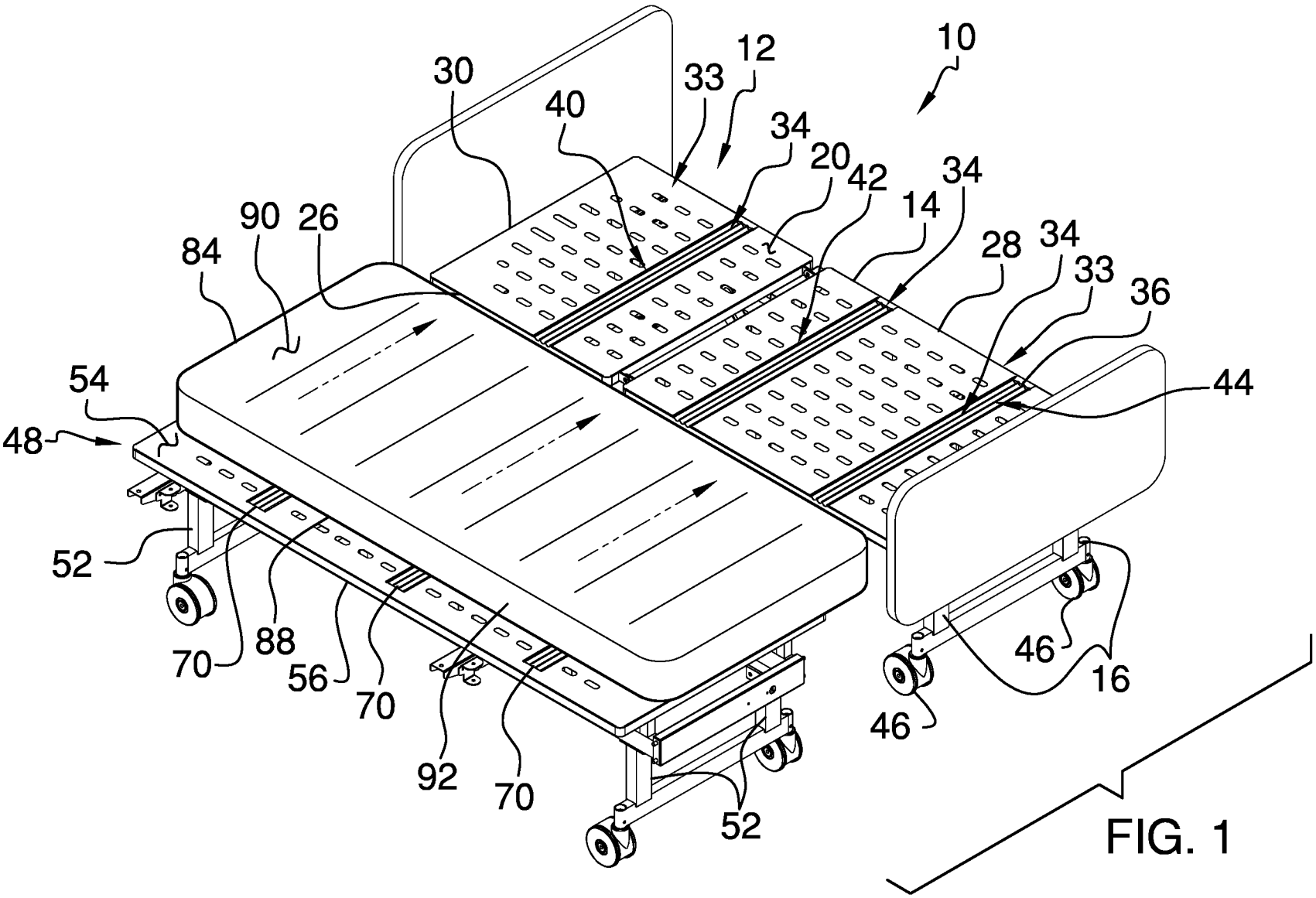
FIG. 1 is a top perspective view of a patient transferring bed assembly according to an embodiment of the disclosure.
Figure 2:
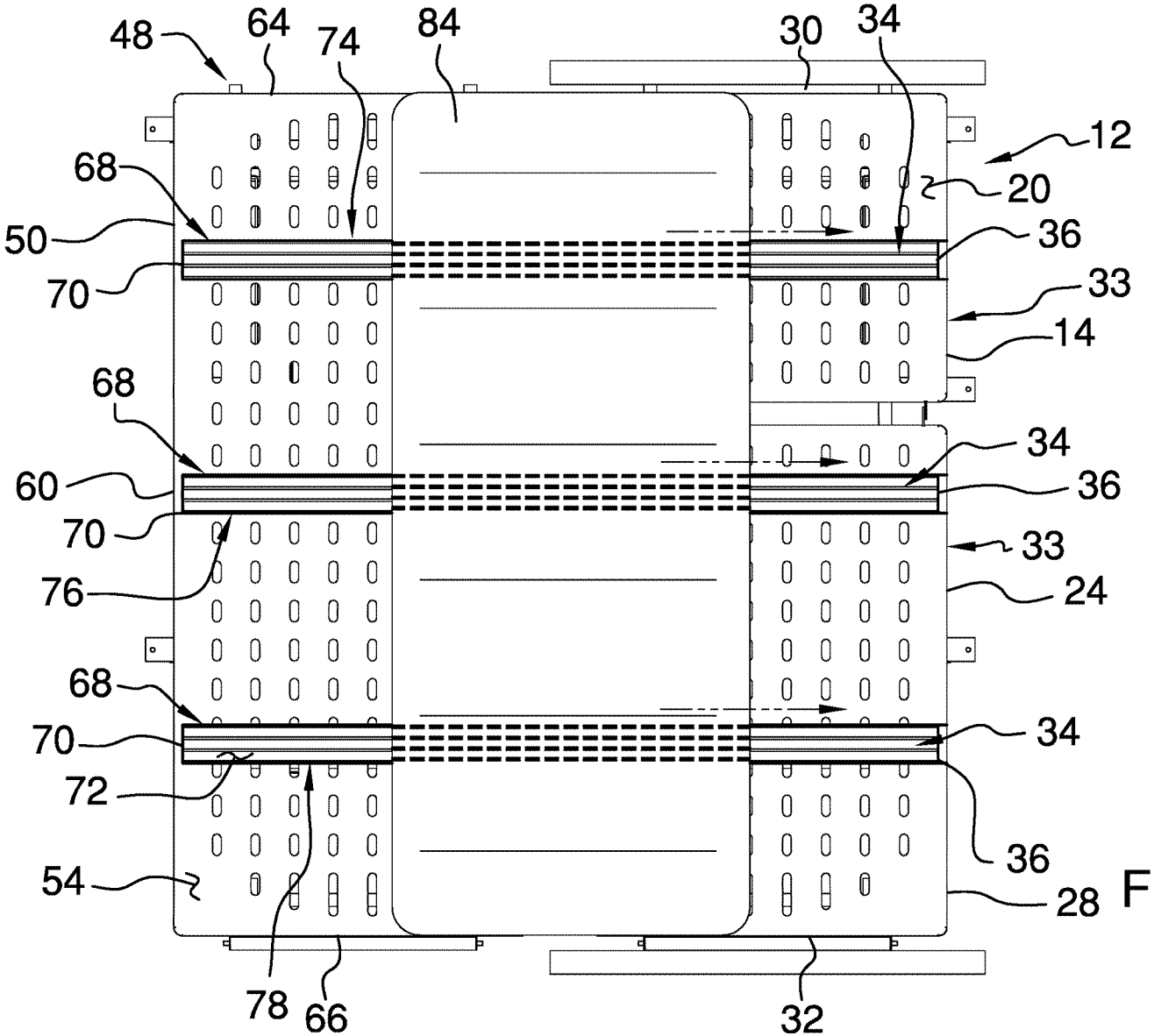
FIG. 2 is a top view of an embodiment of the disclosure showing a mattress being slid between a gurney and a hospital bed.
Figure 3:
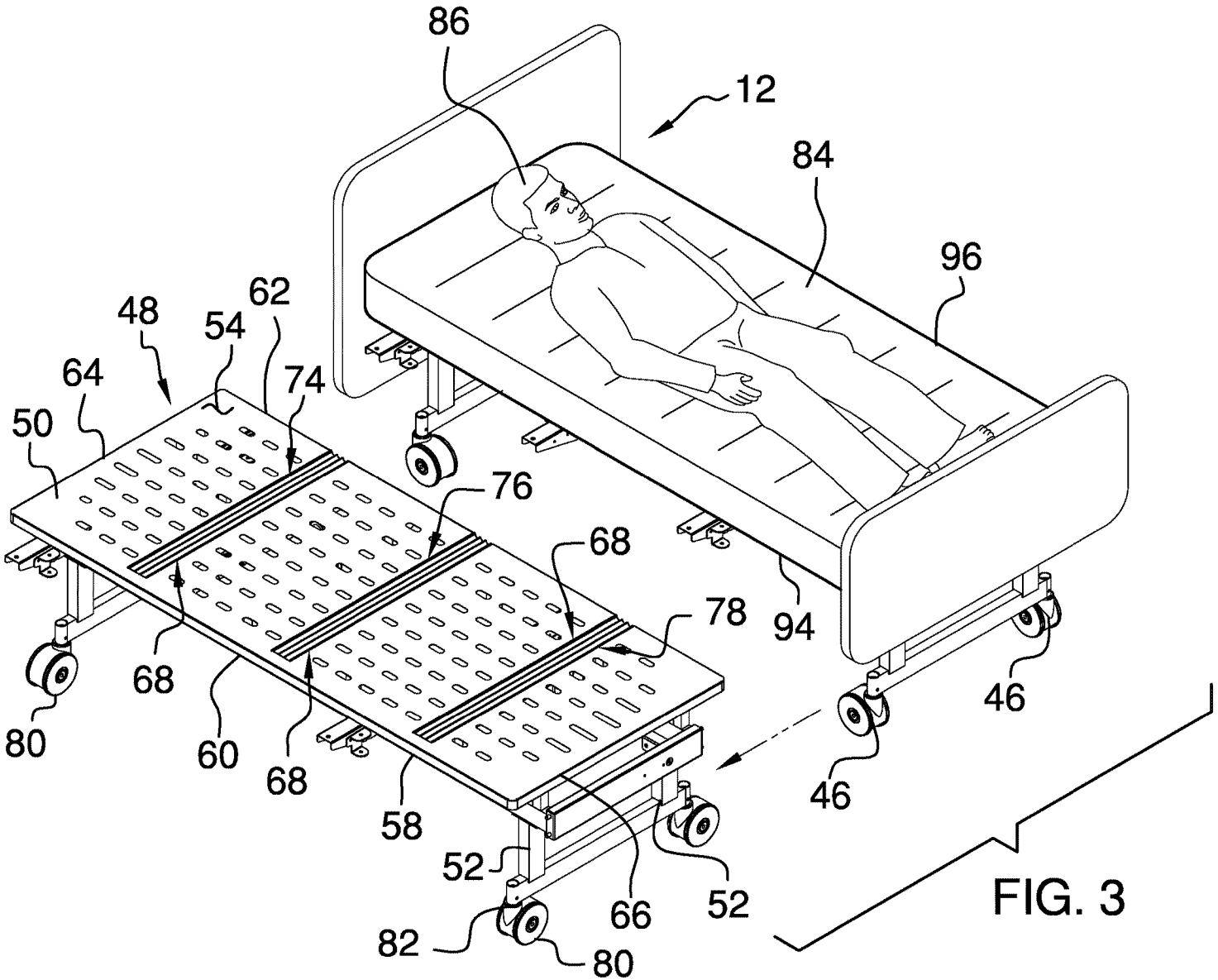
FIG. 3 is a perspective view of an embodiment of the disclosure showing a gurney being moved away from a hospital bed.
Figure 4:
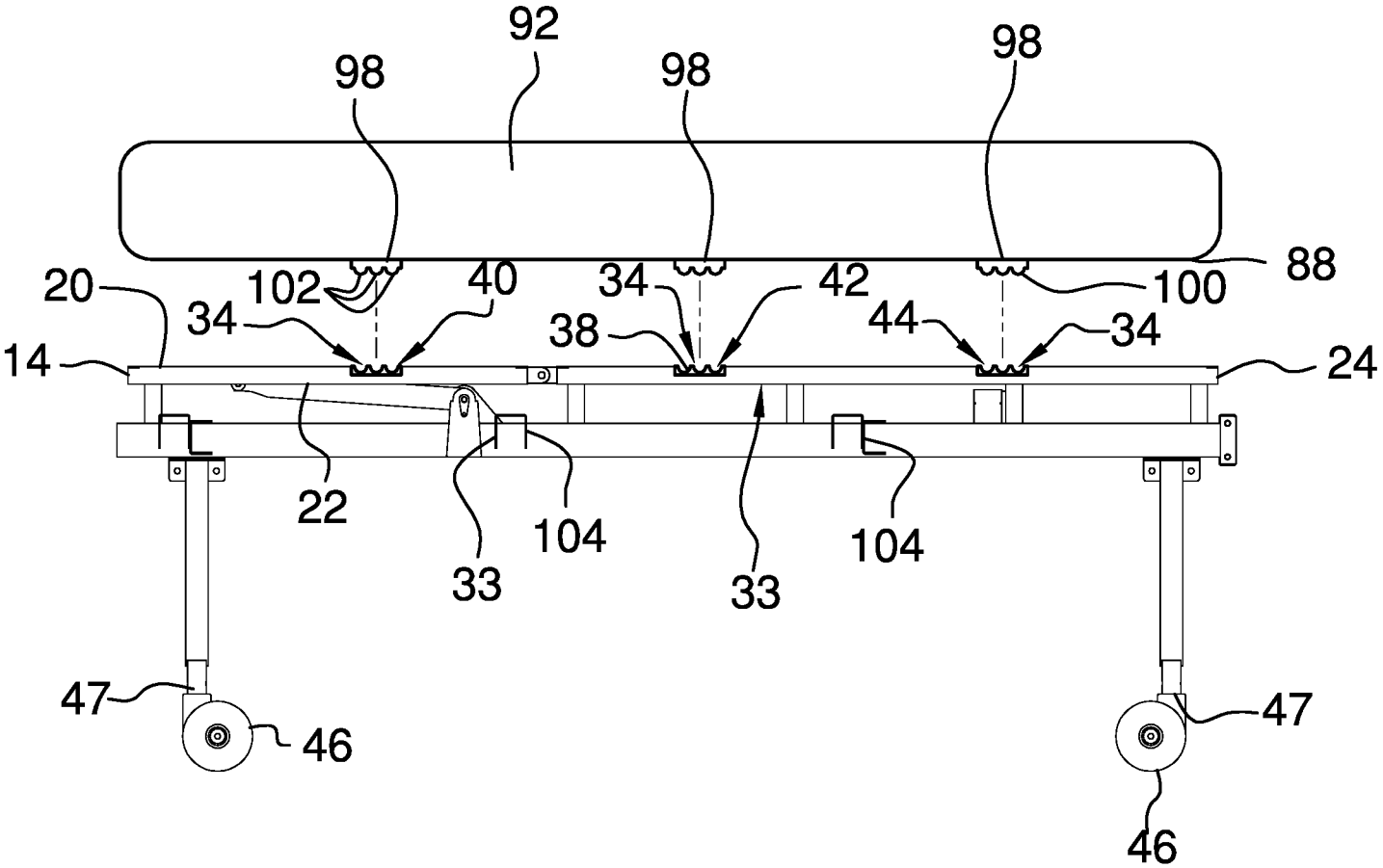
FIG. 4 is a right side exploded view of an embodiment of the disclosure.
Figure 5:
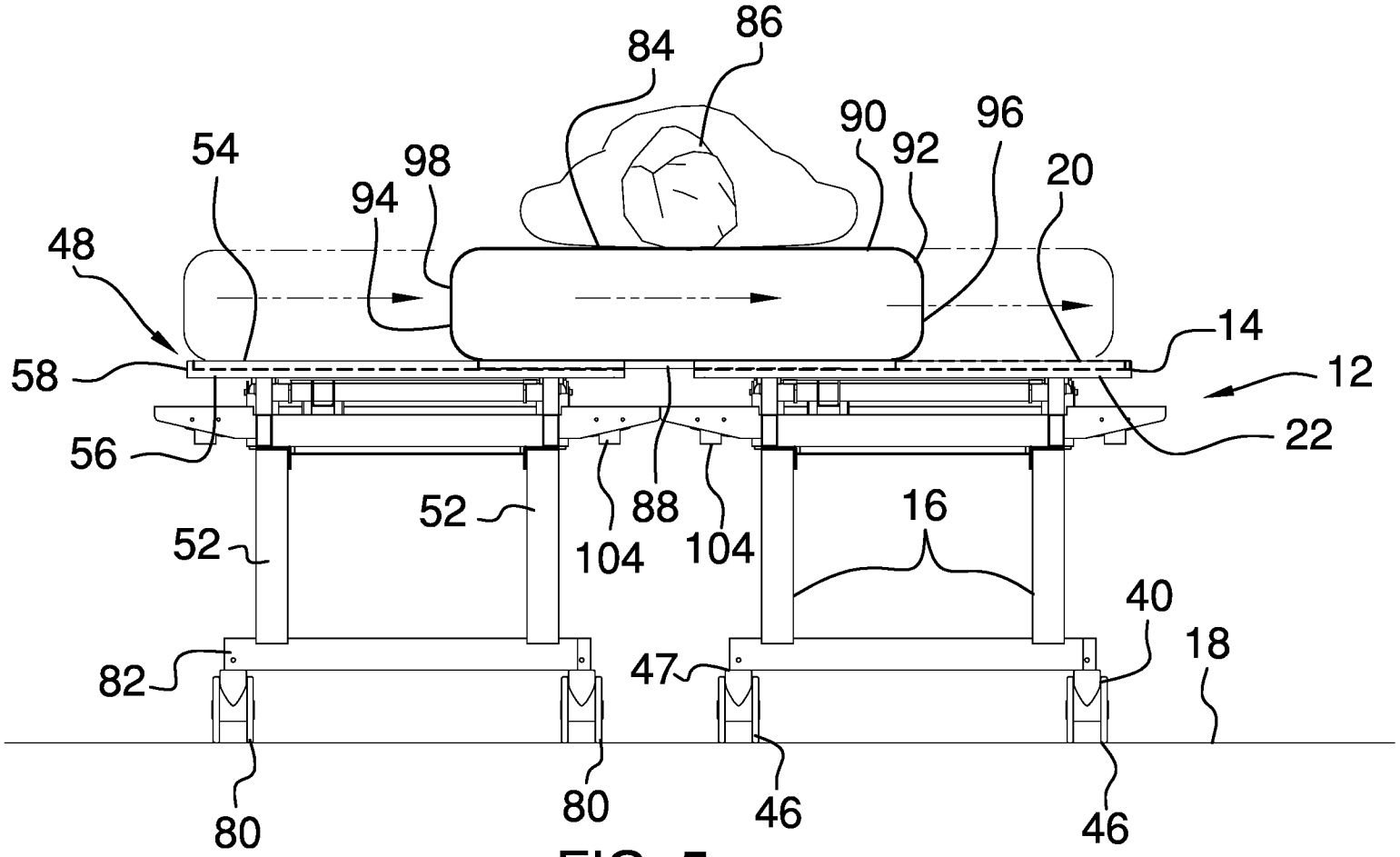
FIG. 5 is a front view of an embodiment of the disclosure showing a mattress being slid from a gurney onto a hospital bed.

With reference now to the drawings, and in particular to FIGS. 1 through 5 thereof, a new patient transferring device embodying the principles and concepts of an embodiment of the disclosure and generally designated by the reference numeral 10 will be described.

As best illustrated in FIGS. 1 through 5, the patient transferring bed assembly 10 generally comprises a hospital bed 12 that has a mattress deck 14 and a plurality of legs 16 each extending downwardly from the mattress deck 14. Thus, each of the legs 16 supports the mattress deck 14 above a support surface 18, such as a floor in a hospital room or the like. The mattress deck 14 has a top surface 20, a bottom surface 22 and a peripheral edge 24 extending therebetween, and the peripheral edge 24 has a first lateral side 26, a second lateral side 28, a front side 30 and a back side 32. Each of the legs 16 is coupled to and extends downwardly from the bottom surface 22. The mattress deck 14 may comprise a pair of individual sections 33 thereby facilitating a head of the hospital bed 12 to be elevated and lowered in the same manner as conventional hospital beds.

The top surface 20 has a plurality of bed channels 34 each extending downwardly toward the bottom surface 22, and each of the bed channels 34 extends from the first lateral side 26 toward the second lateral side 28. Moreover, each of the bed channels 34 has a terminal end 36 adjacent to the second lateral side 28. Each of the bed channels 34 has a bounding surface 38 and the bounding surface 38 of each of the bed channels 34 is concavely arcuate with respect to the top surface 20 of the mattress deck 14.

The plurality of bed channels 34 is arranged into a set of first bed channels 40, a set of second bed channels 42 and a set of third bed channels 44. The sets of first 40, second 42 and third 44 bed channels are spaced apart from each other and are distributed between the front side 30 and the back side 32 of the peripheral edge 24 of the mattress deck 14. A plurality of bed wheels 46 is each rotatably coupled to a bottom end 47 of a respective one of the legs 16 for rolling the hospital bed 12 along the support surface 18. Each of the bed wheels 46 may be locking casters or other wheels that are common to hospital beds.

A gurney 48 is provided that has a mattress panel 50 and a plurality of legs 52 each extending downwardly from the mattress panel 50. Thus, the legs 52 on the gurney 48 support the mattress panel 50 above a support surface 18, such as the floor of the hospital room or the like. The gurney 48 is positionable in a transferring position having the mattress panel 50 being positioned adjacent to and being oriented coextensive with the mattress deck 14 on the hospital bed 12.

The mattress panel 50 has an upper surface 54, a lower surface 56 and an outer edge 58 extending therebetween, and the outer edge 58 has a first lateral side 60, a second lateral side 62, a front side 64 and a back side 66. Each of the legs 52 on the gurney 48 is coupled to and extends downwardly from the lower surface 56 of the mattress panel 50. The upper surface 54 has a plurality of gurney channels 68 each extending downwardly toward the lower surface 56. Each of the gurney channels 68 extends from the second lateral side 62 of the outer edge 58 toward the first lateral side 60 of the outer edge 58. Moreover, each of the gurney channels 68 has a terminal end 70 adjacent to the first lateral side 60 of the outer edge 58. Each of the gurney channels 68 has a bounding surface 72 and the bounding surface 72 of each of the gurney channels 68 is concavely arcuate with respect to the upper surface 54 of the mattress panel 50.

The plurality of gurney channels 68 is arranged into a set of first gurney channels 74, a set of second gurney channels 76 and a set of third gurney channels 78. The sets of first 74, second 76 and third 78 gurney channels are spaced apart from each other and are distributed between the front side 30 and the back side 32 of the outer edge 58 of the mattress panel 50. The second lateral side 28 of the outer edge 58 of the mattress panel 50 on the gurney 48 is positioned adjacent to the first lateral side 26 of the peripheral edge 24 of the mattress deck 14 on the hospital bed 12 has each of the sets of first 74, second 76 and third 78 gurney channels is aligned with a respective one of the sets of first 40, second 42 and third 44 bed channels when the gurney 48 is positioned in the transferring position. Additionally, the upper surface 54 of the mattress panel 50 lies on a plane that is coplanar with the top surface 20 of the mattress deck 14 when the gurney 48 is positioned in the transferring position. A plurality of gurney wheels 80 is each of the gurney wheels 80 is rotatably coupled to a bottom end 82 of a respective one of the legs 52 on the gurney 48 for rolling the gurney 48 along the support surface 18.

A mattress 84 is provided and the patient 86 lies on the mattress 84. The patient 86 may be an individual in a nursing home, an individual in a hospital or any other immobile or disabled individual. The mattress 84 is slidably coupled to the mattress panel 50 on the gurney 48. Additionally, the mattress 84 slidably engages the mattress deck 14 on the hospital bed 12 when the gurney 48 is positioned in the transferring position and the mattress 84 is urged to slide laterally onto the mattress deck 14. In this way the mattress 84 facilitates the patient 86 to be transferred from the gurney 48 to the hospital bed 12 without requiring the patient 86 to be lifted.

The mattress 84 has a lower side 88, an upper side 90 and an exterior side 92 extending therebetween, and the patient 86 lies on the upper side 90. The exterior side 92 has a first lateral surface 94 and a second lateral surface 96. A plurality of rails 98 is each coupled to the lower side 88 of the mattress 84, and each of the rails 98 extends between the first lateral surface 94 and the second lateral surface 96. Each of the rails 98 has a lower surface 100, and the lower surface 100 of each of the rails 98 has a plurality of lobes 102 thereon each extending between the first 94 and second 96 lateral surfaces of the mattress 84.

Each of the rails 98 is aligned with a respective one of the sets of first 74, second 76 and third 78 gurney channels. Additionally, each of the lobes 102 on each of the rails 98 slidably engages the bounding surface 72 of a respective one of the gurney channels 68 in the respective set of first 74, second 76 and third 78 gurney channels. Each of the lobes 102 slides into a respective one of the bed channels 34 when the gurney 48 is positioned in the transferring position and the mattress 84 is urged to slide laterally between the gurney 48 and the hospital bed 12. In this way the mattress 84 and the patient 86, rather than just the patient 86 themselves, are moved from the gurney 48 to the hospital bed 12. Each of the gurney 48 and the hospital bed 12 may have a plurality of engagements 104 thereon. Each of the engagements 104 on the gurney 48 may be aligned with and releasably engage a respective one of the engagements 104 on the hospital bed 12 when the gurney 48 is positioned in the transferring position. In this way the gurney 48 may be releasably attached to the hospital bed 12, In use, the mattress 84 is positioned on the gurney 48 and the patient 86 is positioned on the mattress 84. The gurney 48 is rolled into the transferring position and thereby aligning each of the sets of first 74, second 76 and third 78 gurney channels with the respective set of first 40, second 42 and third 44 bed channels. The mattress 84 is slid laterally across the gurney 48 and each of the rails 98 slidably engages the respective sets of first 40, second 42 and third 44 bed channels. The mattress 84 is slid laterally across the mattress deck 14 on the hospital bed 12 until each of the lobes 102 on each of the rails 98 abuts the terminal end 36 of the respective bed channel 34. In this way the patient 86 can be transferred between the gurney 48 and the hospital bed 12 without requiring the patient 86 to be lifted. Thus, caregivers are protected from developing back injuries and other injuries common to lifting and transferring patients from a gurney to a hospital bed. Additionally, the patient 86 can be transferred from the bed 12 to the gurney 48 in the same process.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A patient transferring bed assembly being configured to slidably transfer a patient from a gurney to a bed without requiring the patient to be lifted, said assembly comprising:

a hospital bed having a mattress deck and a plurality of legs each extending downwardly from said mattress deck wherein each of said legs is configured to support said mattress deck above a support surface;

a plurality of bed wheels, each of said bed wheels being rotatably coupled to a bottom end of a respective one of said legs for rolling said hospital bed along the support surface;

a gurney having a mattress panel and a plurality of legs each extending downwardly from said mattress panel wherein said legs on said gurney are configured to support said mattress panel above a support surface, said gurney being positionable in a transferring position having said mattress panel being positioned adjacent to and being oriented coextensive with said mattress deck on said hospital bed;

a plurality of gurney wheels, each of said gurney wheels being rotatably coupled to a bottom end of a respective one of said legs on said gurney for rolling said gurney along the support surface;

a mattress having a patient lying thereupon, said mattress being slidably coupled to said mattress panel on said gurney, said mattress slidably engaging said mattress deck on said hospital bed when said gurney is positioned in said transferring position and said mattress is urged to slide laterally onto said mattress deck wherein said mattress is configured to transfer the patient from said gurney to said hospital bed without requiring the patient to be lifted;

wherein said mattress deck has a top surface, a bottom surface and a peripheral edge extending therebetween, said peripheral edge having a first lateral side, a second lateral side, a front side and a back side, each of said legs being coupled to and extending downwardly from said bottom surface;

said top surface has a plurality of bed channels extending downwardly toward said bottom surface, each of said bed channels extending from said first lateral side toward said second lateral side, each of said bed channels having a terminal end adjacent to said second lateral side;

wherein each of said bed channels has a bounding surface, said bounding surface of each of said bed channels being concavely arcuate with respect to said top surface of said mattress deck, said plurality of bed channels being arranged into a set of first bed channels, a set of second bed channels and a set of third bed channels, said sets of first, second and third bed channels being spaced apart from each other and being distributed between said front side and said back side of said peripheral edge of said mattress deck;

said mattress panel having an upper surface, a lower surface and an outer edge extending therebetween, said outer edge having a first lateral side, a second lateral side, a front side and a back side, each of said legs on said gurney being coupled to and extending downwardly from said lower surface of said mattress panel; and said upper surface having a plurality of gurney channels each extending downwardly toward said lower surface, each of said gurney channels extending from said second lateral side of said outer edge toward said first lateral side of said outer edge, each of said gurney channels having a terminal end adjacent to said first lateral side of said outer edge.

2. The assembly according to claim 1, wherein each of said gurney channels has a bounding surface, said bounding surface of each of said gurney channels being concavely arcuate with respect to said upper surface of said mattress panel, said plurality of gurney channels being arranged into a set of first gurney channels, a set of second gurney channels and a set of third gurney channels, said sets of first, second and third gurney channels being spaced apart from each other and being distributed between said front side and said back side of said outer edge of said mattress panel.

3. The assembly according to claim 2, wherein:

said second lateral side of said outer edge of said mattress panel on said gurney is positioned adjacent to said first lateral side of said peripheral edge of said mattress deck on said hospital bed having each of said sets of first, second and third gurney channels being aligned with a respective one of said sets of first, second and third bed channels when said gurney is positioned in said transferring position; and said upper surface of said mattress panel lying on a plane being coplanar with said top surface of said mattress deck when said gurney is positioned in said transferring position.

4. A patient transferring bed assembly being configured to slidably transfer a patient from a gurney to a bed without requiring the patient to be lifted, said assembly comprising:

a hospital bed having a mattress deck and a plurality of legs each extending downwardly from said mattress deck wherein each of said legs is configured to support said mattress deck above a support surface, said mattress deck having a top surface, a bottom surface and a peripheral edge extending therebetween, said peripheral edge having a first lateral side, a second lateral side, a front side and a back side, each of said legs being coupled to and extending downwardly from said bottom surface, said top surface having a plurality of bed channels extending downwardly toward said bottom surface, each of said bed channels extending from said first lateral side toward said second lateral side, each of said bed channels having a terminal end adjacent to said second lateral side, each of said bed channels having a bounding surface, said bounding surface of each of said bed channels being concavely arcuate with respect to said top surface of said mattress deck, said plurality of bed channels being arranged into a set of first bed channels, a set of second bed channels and a set of third bed channels, said sets of first, second and third bed channels being spaced apart from each other and being distributed between said front side and said back side of said peripheral edge of said mattress deck;

a plurality of bed wheels, each of said bed wheels being rotatably coupled to a bottom end of a respective one of said legs for rolling said hospital bed along the support surface;

a gurney having a mattress panel and a plurality of legs each extending downwardly from said mattress panel wherein said legs on said gurney are configured to support said mattress panel above a support surface, said gurney being positionable in a transferring position having said mattress panel being positioned adjacent to and being oriented coextensive with said mattress deck on said hospital bed, said mattress panel having an upper surface, a lower surface and an outer edge extending therebetween, said outer edge having a first lateral side, a second lateral side, a front side and a back side, each of said legs on said gurney being coupled to and extending downwardly from said lower surface of said mattress panel, said upper surface having a plurality of gurney channels each extending downwardly toward said lower surface, each of said gurney channels extending from said second lateral side of said outer edge toward said first lateral side of said outer edge, each of said gurney channels having a terminal end adjacent to said first lateral side of said outer edge, each of said gurney channels having a bounding surface, said bounding surface of each of said gurney channels being concavely arcuate with respect to said upper surface of said mattress panel, said plurality of gurney channels being arranged into a set of first gurney channels, a set of second gurney channels and a set of third gurney channels, said sets of first, second and third gurney channels being spaced apart from each other and being distributed between said front side and said back side of said outer edge of said mattress panel, said second lateral side of said outer edge of said mattress panel on said gurney being positioned adjacent to said first lateral side of said peripheral edge of said mattress deck on said hospital bed having each of said sets of first, second and third gurney channels being aligned with a respective one of said sets of first, second and third bed channels when said gurney is positioned in said transferring position, said upper surface of said mattress panel lying on a plane being coplanar with said top surface of said mattress deck when said gurney is positioned in said transferring position;

a plurality of gurney wheels, each of said gurney wheels being rotatably coupled to a bottom end of a respective one of said legs on said gurney for rolling said gurney along the support surface;

a mattress having a patient lying thereupon, said mattress being slidably coupled to said mattress panel on said gurney, said mattress slidably engaging said mattress deck on said hospital bed when said gurney is positioned in said transferring position and said mattress is urged to slide laterally onto said mattress deck wherein said mattress is configured to transfer the patient from said gurney to said hospital bed without requiring the patient to be lifted, said mattress having a lower side, an upper side and an exterior side extending therebetween, said upper side being configured to have the patient lying thereupon, said exterior side having a first lateral surface and a second lateral surface.

5. The assembly according to claim 4, further comprising a plurality of rails, each of said rails being coupled to said lower side of said mattress, each of said rails extending between said first lateral surface and said second lateral surface, each of said rails having a lower surface, said lower surface of each of said rails having a plurality of lobes thereon each extending between said first and second lateral surfaces of said mattress.

6. The assembly according to claim 5, wherein each of said rails is aligned with a respective one of said sets of first, second and third gurney channels, each of said lobes on each of said rails slidably engaging said bounding surface of a respective one of said gurney channels in said respective set of first, second and third gurney channels, each of said lobes sliding into a respective one of said bed channels when said gurney is positioned in said transferring position and said mattress is urged to slide laterally between said gurney and said hospital bed.

7. A patient transferring bed assembly being configured to slidably transfer a patient from a gurney to a bed without requiring the patient to be lifted, said assembly comprising:

a hospital bed having a mattress deck and a plurality of legs each extending downwardly from said mattress deck wherein each of said legs is configured to support said mattress deck above a support surface, said mattress deck having a top surface, a bottom surface and a peripheral edge extending therebetween, said peripheral edge having a first lateral side, a second lateral side, a front side and a back side, each of said legs being coupled to and extending downwardly from said bottom surface, said top surface having a plurality of bed channels extending downwardly toward said bottom surface, said each of said bed channels extending from said first lateral side toward said second lateral side, each of said bed channels having a terminal end adjacent to said second lateral side, each of said bed channels having a bounding surface, said bounding surface of each of said bed channels being concavely arcuate with respect to said top surface of said mattress deck, said plurality of bed channels being arranged into a set of first bed channels, a set of second bed channels and a set of third bed channels, said sets of first, second and third bed channels being spaced apart from each other and being distributed between said front side and said back side of said peripheral edge of said mattress deck;

a plurality of bed wheels, each of said bed wheels being rotatably coupled to a bottom end of a respective one of said legs for rolling said hospital bed along the support surface;

a gurney having a mattress panel and a plurality of legs each extending downwardly form said mattress panel wherein said legs on said gurney are configured to support said mattress panel above a support surface, said gurney being positionable in a transferring position having said mattress panel being positioned adjacent to and being oriented coextensive with said mattress deck on said hospital bed, said mattress panel having an upper surface, a lower surface and an outer edge extending therebetween, said outer edge having a first lateral side, a second lateral side, a front side and a back side, each of said legs on said gurney being coupled to and extending downwardly from said lower surface of said mattress panel, said upper surface having a plurality of gurney channels each extending downwardly toward said lower surface, each of said gurney channels extending from said second lateral side of said outer edge toward said first lateral side of said outer edge, each of said gurney channels having a terminal end adjacent to said first lateral side of said outer edge, each of said gurney channels having a bounding surface, said bounding surface of each of said gurney channels being concavely arcuate with respect to said upper surface of said mattress panel, said plurality of gurney channels being arranged into a set of first gurney channels, a set of second gurney channels and a set of third gurney channels, said sets of first, second and third gurney channels being spaced apart from each other and being distributed between said front side and said back side of said outer edge of said mattress panel, said second lateral side of said outer edge of said mattress panel on said gurney being positioned adjacent to said first lateral side of said peripheral edge of said mattress deck on said hospital bed having each of said sets of first, second and third gurney channels being aligned with a respective one of said sets of first, second and third bed channels when said gurney is positioned in said transferring position, said upper surface of said mattress panel lying on a plane being coplanar with said top surface of said mattress deck when said gurney is positioned in said transferring position;

a plurality of gurney wheels, each of said gurney wheels being rotatably coupled to a bottom end of a respective one of said legs on said gurney for rolling said gurney along the support surface;

a mattress having a patient lying thereupon, said mattress being slidably coupled to said mattress panel on said gurney, said mattress slidably engaging said mattress deck on said hospital bed when said gurney is positioned in said transferring position and said mattress is urged to slide laterally onto said mattress deck wherein said mattress is configured to transfer the patient from said gurney to said hospital bed without requiring the patient to be lifted, said mattress having a lower side, an upper side and an exterior side extending therebetween, said upper side being configured to have the patient lying thereupon, said exterior side having a first lateral surface and a second lateral surface; and a plurality of rails, each of said rails being coupled to said lower side of said mattress, each of said rails extending between said first lateral surface and said second lateral surface, each of said rails having a lower surface, said lower surface of each of said rails having a plurality of lobes thereon each extending between said first and second lateral surfaces of said mattress, each of said rails being aligned with a respective one of said sets of first, second and third gurney channels, each of said lobes on each of said rails slidably engaging said bounding surface of a respective one of said gurney channels in said respective set of first, second and third gurney channels, each of said lobes sliding into a respective one of said bed channels when said gurney is positioned in said transferring position and said mattress is urged to slide laterally between said gurney and said hospital bed.

* * * * *